United States Patent [19]

Puttock et al.

[11] Patent Number: 5,000,757

[45] Date of Patent: Mar. 19, 1991

[54] PREPARATION AND COMBUSTION OF FUEL OIL EMULSIONS

[75] Inventors: Simon J. Puttock, Middlesex; Ian D. Somerville, Hampshire, both of England

[73] Assignee: British Petroleum Company p.l.c., London, United Kingdom

[21] Appl. No.: 224,421

[22] Filed: Jul. 26, 1988

[30] Foreign Application Priority Data

Jul. 28, 1987 [GB] United Kingdom ..... 8717836

[51] Int. Cl.[5] ..... C10L 1/32

[52] U.S. Cl. ..... 44/301; 44/442; 431/4

[58] Field of Search ..... 44/51; 431/4, 150; 366/177, 182

[56] References Cited

U.S. PATENT DOCUMENTS

| | | | |
|---|---|---|---|
| 1,611,429 | 12/1926 | Fish | 44/51 |
| 1,614,560 | 1/1927 | Kirschbraun | 44/51 |
| 1,701,621 | 2/1929 | Kirschbraun | 44/51 |
| 1,975,631 | 10/1934 | Bonfield | 44/51 |
| 2,461,580 | 2/1949 | Kokatnu et al. | 44/51 |
| 3,527,581 | 9/1970 | Brownawell et al. | 44/51 |
| 3,565,817 | 2/1971 | Lissant | 252/312 |
| 3,658,302 | 4/1972 | Sequla et al. | 44/51 |
| 3,766,942 | 10/1973 | Delatronchette et al. | 431/4 |
| 4,116,610 | 9/1978 | Berthiaume | 44/51 |
| 4,173,449 | 11/1979 | Israel | 431/4 |
| 4,218,221 | 8/1980 | Cottell | 44/51 |
| 4,618,348 | 10/1986 | Hayes et al. | 44/51 |
| 4,696,638 | 9/1987 | Den Herder | 431/4 |
| 4,708,753 | 11/1987 | Forsberg | 149/2 |

FOREIGN PATENT DOCUMENTS

| | | |
|---|---|---|
| EP0156486 | 2/1985 | European Pat. Off. . |
| 0214843 | 3/1987 | European Pat. Off. . |
| 0974042 | 4/1964 | United Kingdom . |
| 2117666 | 10/1983 | United Kingdom . |

*Primary Examiner*—Margaret B. Medley

*Attorney, Agent, or Firm*—C. S. Lynch; D. J. Untener; L. W. Evans

[57] ABSTRACT

Apparatus for the preparation of emulsions of oil in water comprises:

(a) an oil feed line, (b) a source of concentrated surfactant solution, (c) a source of water, (d) a first low shear mixer for mixing concentrated surfactant and water to form a dilute surfactant solution, (e) means for uniting the flows of dilute surfactant solution and oil in a controlled manner, (f) a second low shear mixer for mixing the united flow streams of oil and dilute surfactant solution to form an emulsion of oil in water, (g) a third low shear mixer for mixing the emulsion of oil in water to form a dilute emulsion, and, (h) an arrangement of water feed lines and control valves such that, firstly, water can be supplied either to the first low shear mixer only or, secondly, to both first and third low shear mixers.

The apparatus is particularly suitable for the preparation of emulsions of fuel oil in water from oils within a wide range of viscosities which burn with low emissions of $NO_x$ and particulates.

19 Claims, 3 Drawing Sheets

PREPARATION AND COMBUSTION OF FUEL OIL EMULSIONS

Figure 1:
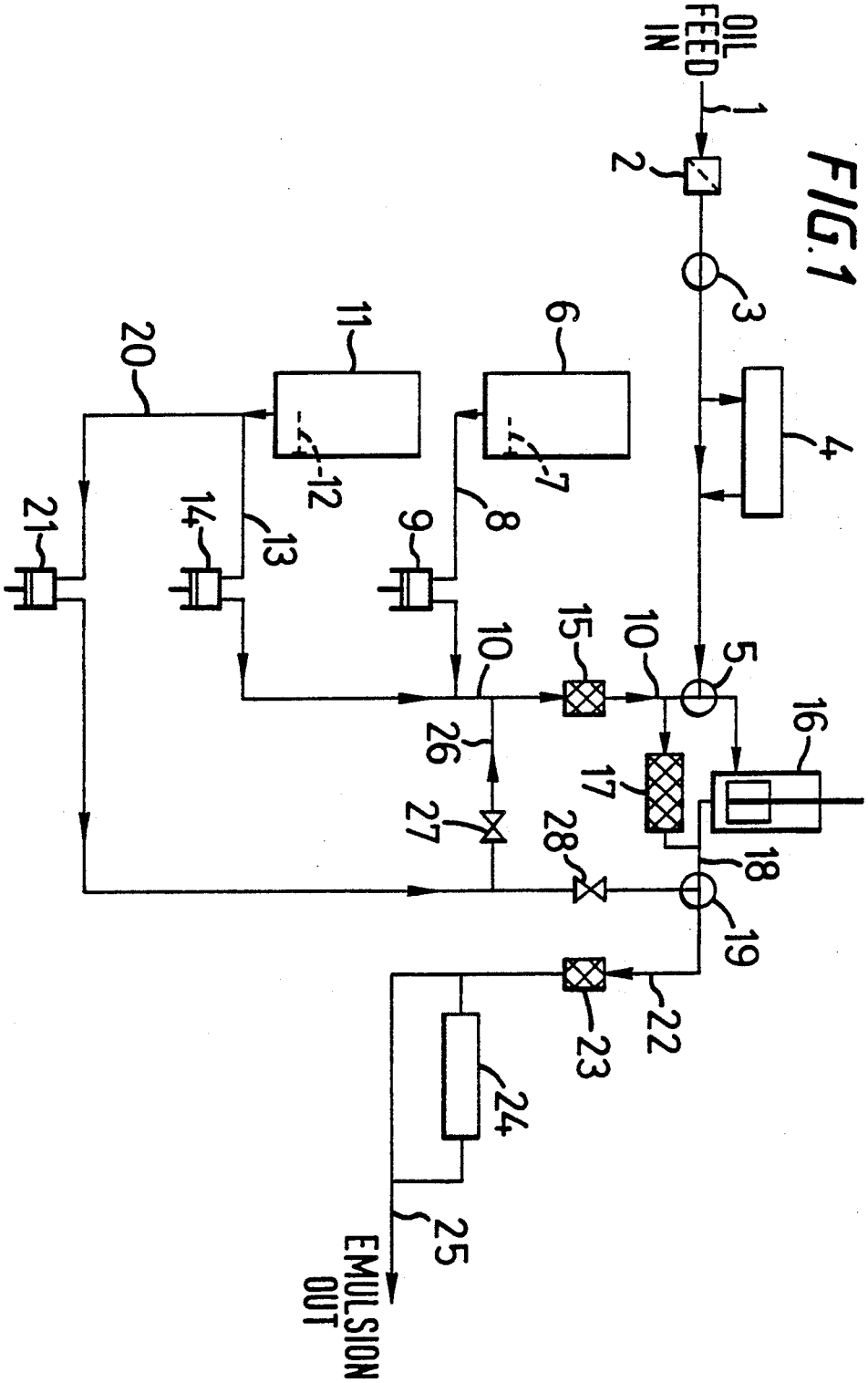

This invention relates to apparatus suitable for the preparation of emulsions of fuel oil in water, to a method for the preparation of emulsions of fuel oil in water and to a method for the combustion of such emulsions.

British Patent Specification 974042 describes "an improved fuel composition comprising an oil-in-water emulsion of a petroleum oil having a viscosity above 40 S.S.F. at 122° F., the amount of water in said emulsion being such that the emulsion has a viscosity of less than 150 S.S.F. at 77° F. and the said oil comprising at least 60 volume percent of the emulsion."

In the preparation of emulsions, the viscosity of the oil at the emulsification temperature is of considerable importance in determining the particle size and particle size distribution of the oil droplets and hence the stability of this emulsion.

Our copending European application 0156486 discloses and claims a method for this preparation of HIPR (High Internal Phase Ratio) emulsions of viscous oils in water which method comprises directly mixing 70 to 98% by volume of a viscous oil with 30 to 2% by volume of an aqueous solution of an emulsifying surfactant or an alkali, percentages being expressed as percentages by volume of the total mixture; characterised by the fact that the oil has a viscosity in the range 200 to 250,000 mPa's at the mixing temperature and mixing is effected under low shear conditions in the range 10 to 1,000 reciprocal seconds in such manner that an emulsion is formed comprising highly distorted oil droplets having mean droplet diameters in the range 2 to 50 micron separated by thin interfacial films.

These emulsions have a high degree of monodispersity, i.e. a narrow particle size distribution.

European 0156486 further discloses that these HIPR emulsions as prepared are stable and can be diluted with aqueous surfactant solution or water to produce emulsions of lower oil phase volume in which the desirable characteristics of the high degree of monodispersity and stability are retained.

It is well known that the viscosity of an oil is a function of its temperature. Thus an oil which is suitable for emulsification by the above process at one temperature may not be suitable at another.

Oils suitable for the production of fuel oil in water emulsions are often produced at various elevated temperatures. For example certain heavy crude oils, which do not require refinery processing, are extracted from the reservoir at elevated temperature. Residues from lighter crudes which have been subjected to refinery processing are also produced at various elevated temperatures. The viscosities of these oils as produced may or may not be suitable for use in the method according to European 0156686.

We have now devised a versatile apparatus for the preparation of emulsions of oil in water which is suitable for use in the preparation of emulsions from oils of a wide range of viscosities.

Thus, according to the present invention there is provided apparatus for the preparation of emulsions of oil in water which apparatus comprises, (a) an oil feed line, (b) a source of concentrated surfactant solution, (c) a source of water, (d) a first low shear mixer for mixing concentrated surfactant and water to form a dilute surfactant solution, (e) means for uniting the flows of dilute surfactant solution and oil in a controlled manner, (f) a second low shear mixer for mixing the united flow streams of oil and dilute surfactant solution to form an emulsion of oil in water, (g) a third low shear mixer for mixing the emulsion of oil in water to form a dilute emulsion, and an arrangement of (h) water feed lines and control valves such that, firstly, water can be supplied either to the first low shear mixer only or, secondly, to both first and third low shear mixers.

In the first mode of operation the emulsion will be formed in one stage with the final concentrations of oil and water being determined by the initial proportions.

In the second mode of operation, the emulsion will be formed in two stages with the emulsion of the first stage being diluted to a lower concentration of oil in water in the second stage.

The first and third low shear mixers are preferably static mixers. These can have lower shear rates than the second low shear mixer. Suitable shear rates for the first and third low shear mixers are in the range 10 to 250 reciprocal seconds.

The second low shear mixer may be an inline blender, a static mixer, or a combination of both connected in parallel so that the oil and dilute surfactant solution can flow through either one or the other for emulsification. This confers even greater flexibility on the apparatus for dealing with differences in oil and water flow rates and oil viscosities.

Suitable shear rates for the second low shear mixer are in the ranges 250 to 5,000 reciprocal seconds.

The inline blender is preferably a vessel having rotating arms or beaters capable of rotating at 250–5,000 r.p.m.

The means (e) for uniting the flows of diluent surfactant solution and oil in a controlled manner may comprise an injection nozzle for the dilute surfactant solution projecting axially into the centre of the oil line so that a core of diluent surfactant solution flows within an annulus of the oil.

An alternative, non-intrusive means (e) comprises an orifice plate which suddenly restricts the flow of surfactant solution to a narrow jet which is injected axially into the oil lines.

The dimensions of the nozzle or the orifice plate and flow rates of oil and surfactant solutions should be chosen so that the flow rates of the oil annulus and the surfactant solution core are the same.

Similar control means should also be provided for uniting the emulsion of oil in water from the second low shear mixer and the further quantity of water to form the dilute emulsion before entry to the third low shear mixer.

Thus the apparatus may additionally comprise:

(i) means for uniting the flows of the first stage emulsion and a further quantity of water in a controlled manner as hereinbefore described.

The flow rates of the surfactant solution and water may be controlled by metering pumps, suitably of the piston kind. However, other types of pumps such as high pressure centrifugal pumps can be used provided a sufficiently accurate metering system is employed.

The apparatus as a whole may be automated for continuous production by incorporating a flow transmitter in the oil feed line and linking this to the flow controllers on the surfactant and water flow lines.

Because the feedstock oil is frequently produced at high temperatures, sometimes too high for emulsification, it is advisable to incorporate a first cooler in the apparatus in the oil feed line before the oil is blended with the dilute surfactant solution. This should be fitted with a bypass so that it may be used as and when required.

When the oil is emulsified under superatmospheric pressure, it may be possible, and indeed desirable, to emulsify the oil at a temperature at which the emulsion is inherently unstable. If the emulsion were allowed to cool gradually it would destabilise.

We have now discovered that if the emulsion is rapidly cooled, however, then it does not destabilise but retains its properties as a stable emulsion.

A second cooler is therefore preferably provided in the emulsion product line downstream of the third low shear mixer.

Thus the apparatus may further comprise:

(j) an oil cooler situated in the oil feed line, and/or, (k) an emulsion cooler situated in the emulsion product line.

The apparatus is suitable for preparing emulsions of either heavy oils or light oils in water.

Thus, according to another aspect of the present invention there is provided a method for the preparation of an emulsion of an oil in water which method comprises the steps of:

(i) mixing concentrated surfactant with water in a first low shear mixer to form a dilute surfactant solution.

(ii) uniting a flow of oil having a viscosity in the range 25 to 250,000 mPa's at the mixing temperature with the flow of dilute surfactant solution in a controlled manner such that a core of surfactant solution flows within an annulus of the oil, the combined flow containing 60 to 98% by volume of oil.

(iii) passing the united flow of oil and dilute surfactant solution through a second low shear mixer in such a manner that an emulsion is formed comprising oil droplets surround by an aqueous film, the oil droplets having a mean droplet diameter in the range 2 to 50 micron, preferably 5 to 20 micron, and a high degree of monodispersity.

If required the method further comprises:

(iv) uniting the flow of the resulting emulsion with a further quantity of water in a controlled manner so that a core of water flows within an annulus of the emulsion, and (v) passing the united flow of emulsion and dilute surfactant solution through a third low shear mixer in such a manner that a diluted emulsion is formed comprising oil droplets in an aqueous medium, the oil droplets having a mean droplet diameter in the range 2 to 50 micron, preferably 5 to 15 micron, and a high degree of monodispersity.

The degree of monodispersity is preferably such that at least 60% of the volume of the oil droplets have a droplet diameter within ±70%, most preferably within ±35%, of the mean droplet diameter.

If the viscosity of the oil at the emulsification temperature is above 200 mPa's it will generally be found more convenient to use a two stage process, i.e. emulsification followed by dilution, to produce emulsions suitable for combustion. If the viscosity of the oil is below 200 m.Pa's, then a one stage process, i.e. emulsification with no further dilution, will usually suffice.

The final concentration of oil is preferably in the range 65 to 75% by volume.

In a two stage process the concentration of oil in the first stage emulsion is preferably in the range 85 to 95% by volume and may be diluted to 60 to 75% in the second stage emulsion.

Suitable oils for treatment include atmospheric and vacuum residues and visbroken oils and residues.

Other oils which can be emulsified include the viscous crude oils to be found in Canada, the USA, Venezuela, and the USSR, for example, Lake Marguerite crude oil from Alberta, Hewitt crude oil from Oklahoma, and Cerro Negro crude oil from the Orinoco oil belt.

Emulsifying surfactants may be non-ionic, ethoxylated ionic, anionic or cationic, but are preferably non-ionic.

Suitable non-ionic surfactants are those whose molecules contain a hydrophobic, hydrocarbyl group and a hydrophilic polyoxyalkylene group containing 9 to 100 ethylene oxide units in total. The preferred non-ionic surfactants are ethoxylated alkyl phenols containing 15 to 30 ethylene oxide units which are inexpensive and commercially available.

An ethoxylated nonyl phenol containing about 20 ethylene oxide units is very suitable.

Single surfactants are suitable and blends of two or more surfactants are not required.

The surfactant is suitably employed in amount 0.5 to 5% by weight, expressed as a percentage by weight of the aqueous solution.

The droplet size can be controlled by varying any or all of the three main parameters: mixing intensity, mixing time and surfactant concentration. Increasing any or all of these will decrease the droplet size.

Emulsification can be carried out over a wide range of temperature, e.g. 20° to 250° C., the temperature being significant insofar as it affects the viscosity of the oils. Emulsification will generally be effected under superatmospheric pressure because of operating constraints.

Emulsions of highly viscous fuel oils in water are frequently as much as three to four orders of magnitude less viscous than the oil itself and consequently are much easier to pump and require considerably less energy to do so. Furthermore, since the oil droplets are already in an atomised state, the emulsified fuel oil is suitable for use in low pressure burners and requires less preheating, resulting in further savings in capital costs and energy.

Fuel oil emulsions produced according to the method of the present invention are of uniform high quality and burn efficiently with low emissions of both particulate material and $NO_x$. This is an unusual and highly beneficial feature of the combustion. Usually low particulate emission is accompanied by high $NO_x$, or vice versa. With a proper burner and optimum excess air the particulate emission can be reduced to the level of the ash content of the fuel whilst still retaining low $NO_x$ emissions.

It is believed that this is a result of the small droplet size and high monodispersity of the emulsions which in turn are the result of the careful blending of the oil and surfactant immediately before emulsification to ensure that a flow of constant composition reaches the mixer, free from slugs of either component which would have the effect of unbalancing the composition of the emulsion. Such emulsions may be prepared by utilising apparatus hereinbefore described.

According to a further aspect of the present invention there is provided a method for the combustion of an emulsified fuel oil prepared by the method as hereinbefore described under conditions such that particulate emissions are reduced to a value close to or at the ash level of the fuel oil and $NO_x$ emissions are reduced.

The most important parameters affecting the combustion of the emulsion, apart from the quality of the emulsion itself, are the type of burner employed, the quantity of excess air used, and possibly the nature of the combustion chamber.

Suitable burners include those containing pressure jet atomisers, steam atomisers and air atomisers.

Suitable quantities of excess air are in the range 5 to 50%, preferably 5 to 20%.

Figure 2:
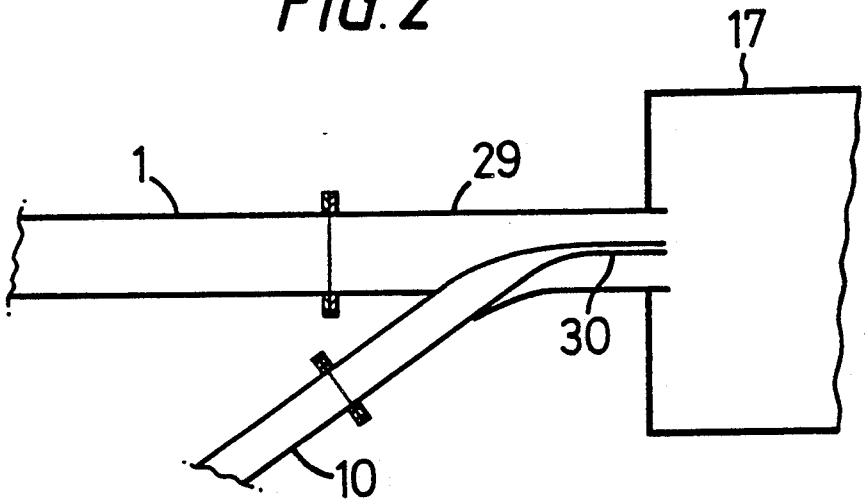
Figure 3:
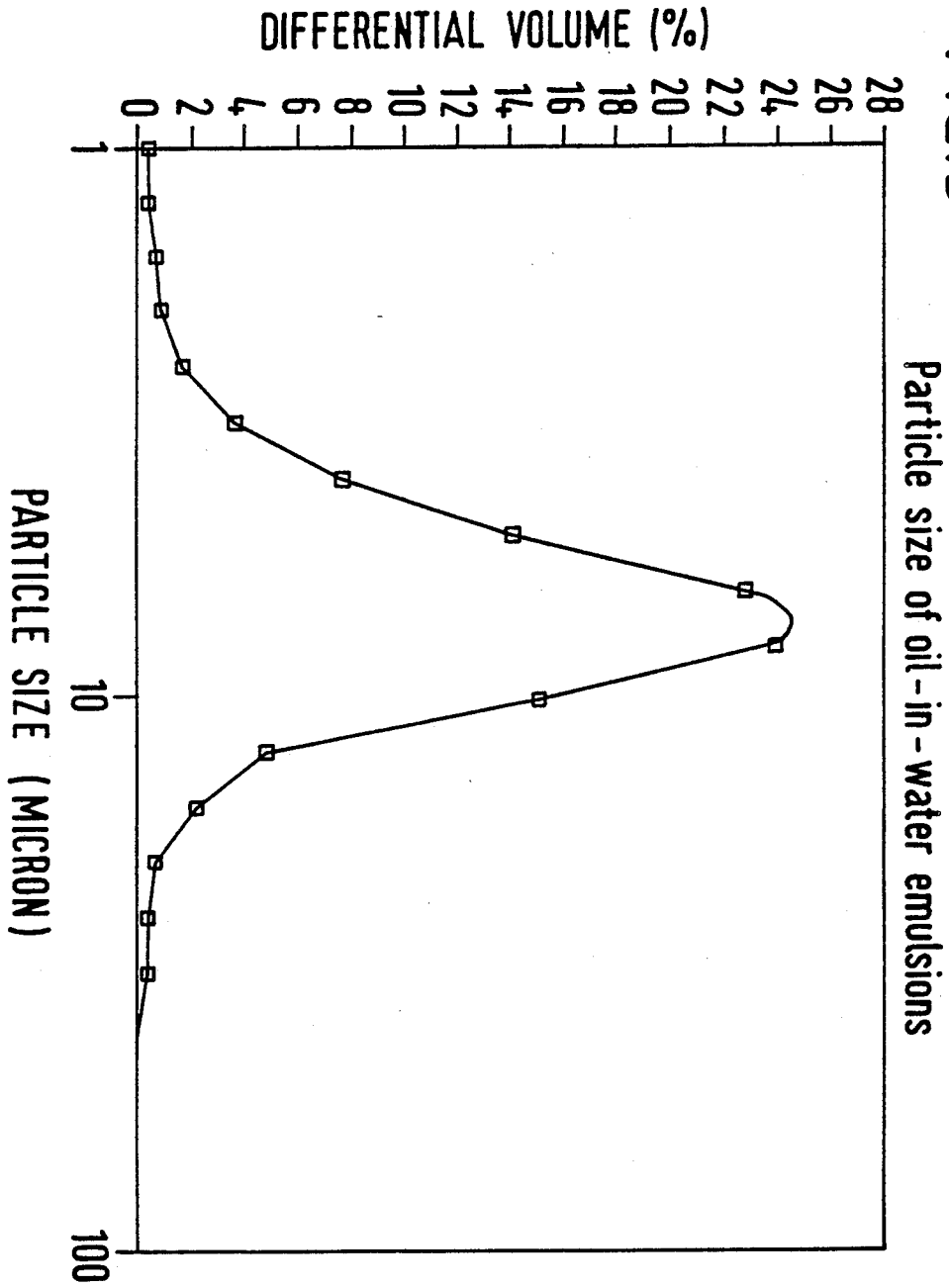

The invention is illustrated with reference to FIGS. 1–3 of the accompanying drawings wherein FIG. 1 is a schematic diagram of emulsifying equipment, FIG. 2 is a detail of a nozzle for injecting surfactant solution into an oil line immediately before emulsification, and FIG. 3 is an oil droplet particle size distribution curve.

With reference to FIG. 1, oil is fed to the system through line and through filter 2. It then passes through a flow transmitter 3 and optionally through a cooler 4 which can be by passed if necessary. The (cooled) oil is then united with dilute surfactant solution in an injector 5 illustrated in more detail in FIG. 2.

Concentrated surfactant solution is held in a storage tank 6 fitted with a heater 7. It emerges by line 8 in which the flow is controlled by a piston metering pump 9 and is united with water in line 10.

Water is held in a second storage tank 11 filled with a heater 12, although it can be supplied directly from the mains or other sources if desired. It emerges by line 13 in which the flow is controlled by a piston metering pump 14 and is combined with the flow of concentrated surfactant solution in line 10 before entering a static mixer 15 in which a dilute surfactant solution is formed which emerges by a continuation of line 10.

The flow of oil and dilute surfactant solution from the injector 5 is then passed either to an inline blender 16 or a static mixer 17 in which the oil and surfactant solution are emulsified to form a water in oil emulsion which is removed by line 18 and passed to a second injector 19. The inline blender 16 and static mixer 17 are shown as both present and connected in parallel. Either could be present singly or as interchangeable units. A second offtake of water is taken from tank 11 by line 20 in which the flow is controlled by a piston metering pump 21 and passed to the second injector 19 to be united with the flow of emulsion from either the inline blender 16 or the static mixer 17.

The combined flow of emulsion and water is then passed by line 22 to a third static mixer 23 where the emulsion is diluted in a uniform manner.

The diluted emulsion is optionally passed through a second cooler 24 which can be bypassed if necessary and removed as product by line 25.

A branch line 26 is provided between water line 20 and the combined surfactant line and water line 10 and a valve 27 is fitted in this line. A second valve 28 is fitted in water line 20 downstream of the branch line 26.

When valve 27 is open and valve 28 is closed, all the water used passes through the inline blender 16 or the static mixer 17 and the operation is a one stage process since there is no dilution of the emulsified product.

When valve 27 is closed and valve 28 is open, the water is supplied in two stages, before and after emulsification.

The flow transmitter 3 is linked with the metering pumps 9,14 and 21 to control the flows of surfactant and water relative to the flow of the oil so that the correct proportions are maintained.

With reference to FIG. 2, the oil line 1 and the dilute surfactant solution line 10 unite in a Y-piece 29 which contains a nozzle 30 for injecting the surfactant solution from the line 10 into the centre of the oil flowline 1 and allowing oil to flow in the surrounding annulus.

The ratio of the area of the annulus to the area of the core is the same as the ratio of the flow rate of the oil to the surfactant. Flow rates are adjusted so that the oil and surfactant solution emerge from the Y-piece as adjacent but separate laminar flows with the same rate of flow.

The Y-piece 29 is shown connected to the static mixer 17.

The invention is further illustrated with reference to the following Example.

EXAMPLE

The selected oil was a fluxed visbroken residue which had the following properties:

| | |
|---|---|
| S.G at 95° C.: | 0.9699 |
| 75° C.: | 0.9822 |
| 70° C.: | 0.9853 |
| Dynamic viscosity at 95° C.: | 143* mPa.s |
| 75° C.: | 452* |
| 70° C.: | 621* |
| Ash content: | 0.06% by wt |

The oil was emulsified using the apparatus described with reference to FIGS. 1 and 2 in a one-step process, i.e. without further dilution of the emulsion initially formed.

Emulsification conditions were as follows:

Surfactant: $NP(EO)_{20}$, i.e. a nonyl phenol ethoxylate containing 20 ethoxylate groups per molecule Oil flow rate: 280 kg/hr Surfactant solution flow rate: 120 kg/hr Speed of mixer blades: 2,500 rpm Temperature of mixing: 90° C.

The resulting emulsion had the following properties:

| | |
|---|---|
| S.G. at 70°: | 0.9868 |
| Dynamic viscosity at 95° C.: | 20 mPa.s* |
| 75° C.: | 33 mPa.s* |
| Oil content: | 30% by wt (nominal) |
| | 30.4% by wt (measured) |
| Water content: | 70% by wt (nominal) |
| Surfactant concentration: | 0.67% by wt of emulsion |

Measured at a shear of 1,000 reciprocal seconds.

The particle size distribution of the oil droplets is given in the accompanying FIG. 3.

The base oil and emulsions were combusted in a suspended flame CCT FR10 burner at 5%, 20% and 50% excess air. This burner is a steam atomiser.

Combustion conditions and results are given in the following Table.

TABLE

| | FUEL OIL | | | | | ATOMISHING STEAM | | | COMBUSTION AIR | | | | |
|---|---|---|---|---|---|---|---|---|---|---|---|---|---|
| | Heat Lib. M Btu/h | Excess Air (Nominal) % | Flow kg/h | Temp. °C. | Press. psig | Flow kg/h | Temp. °C. | Press. psig | Flow kg/h | Temp. °C. | Wind-Box Press. bar | Hearth Draught bar | RDL bar |
| BASE FUEL | 10.75 | 5 | 284 | 160 | 107 | 41 | 170 | 113 | 3899 | 25 | 2.54 | −1.76 | 4.30 |
| | 10.75 | 20 | 284 | 160 | 110 | 41 | 171 | 117 | 4585 | 24 | 4.19 | −1.63 | 5.82 |
| | 10.75 | 50 | 284 | 161 | 112 | 39 | 171 | 117 | 5688 | 24 | 8.92 | −1.34 | 10.26 |
| 30.4% | 10.75 | 5 | .(1) | 96 | 121 | 43 | 207 | 107 | 4019 | 26 | 2.15 | −2.22 | 4.37 |
| Water | 10.75 | 20 | .(1) | 95 | 120 | 43 | 271 | 107 | 4622 | 25 | 3.40 | −2.26 | 5.66 |
| 7.1 um | 10.75 | 50 | .(1) | 95 | 120 | 43 | 217 | 107 | 5671 | 25 | 6.46 | −2.06 | 8.53 |

| | EMISSIONS | | | | | | | | | | | FLAME |
|---|---|---|---|---|---|---|---|---|---|---|---|---|
| | Excess Air (Nominal) % | Flue Gas Temp °C. | Furnace Temp. at Hearth °C. | Solids % wt of Fuel | Smoke No | $SO_2$ ppm | $O_2$ % | CO ppm | $NO_x$ (wet) | H/C ppm | | Dimensions Height/ Width m |
| BASE FUEL | 5 | 740 | 699 | 0.70 | 8–9 | 1400 | 1.0 | 33 | 320 | 1.3 | | 7.2/1.2 |
| | 20 | 740 | 691 | 0.20 | 5–6 | 1070 | 3.6 | 24 | 380 | 1.0 | | 6.7/1.2 |
| | 50 | 724 | 607 | 0.26 | 6 | 1030 | 7.1 | 30 | 320 | 0.9 | | 4.0/1.1 |
| 30.4% | 5 | 732 | 672 | 0.05 | 6 | 1040 | 1.1 | 23 | 160 | 0.6 | | 6.6/1.2 |
| Water | 20 | 720 | 648 | 0.05 | 3 | 840 | 3.7 | 16 | 335 | 0.6 | | 3.7/1.2 |
| 7.1 um | 50 | 710 | — | 0.05 | 2 | 680 | 7.1 | 17 | 330 | 0.2 | | 3.4/1.2 |

(1) Theoretical fuel flow to maintain required liberation due to the water content of the fuel.

It will be noted that the solids emissions of the base fuel were very much higher than that of the emulsified fuel. The solids emission of the emulsified fuel were reduced to a value corresponding to the ash content of the fuel oil.

At 5% excess air the $NO_x$ content of the emissions from the base fuel was twice as much as that from the emulsion. At 20% excess air the difference is still marked. At 50% there is little difference and in practice this level of excess air is unlikely to be used because of the cooling effect it has on the flame.

We claim:

1. A method for the preparation of an emulsion of an oil in water which method comprises the steps of:
   (i) mixing concentrated surfactant with water in a first low shear mixer to form a dilute surfactant solution,
   (ii) uniting a flow of oil having a viscosity in the range of 25 to 250,000 mPa's at the mixing temperature with the flow of dilute surfactant solution in a controlled manner such that a core of surfactant solution flows within an annulus of the oil, the combined flow containing 60 to 98% by volume of oil,
   (iii) passing the united flow of oil and dilute surfactant solution through a second low shear mixer in such a manner that an emulsion is formed comprising oil droplets surrounded by an aqueous film, the oil droplets having a mean droplet diameter in the range 2 to 50 micron, and a high degree of monodispersity.

2. A method according to claim 1 wherein the viscosity of the oil is below 200 mPa's.

3. A method according to claim 1 further comprising the steps of:
   (iv) uniting the flow of the resulting emulsion with a further quantity of water in a controlled manner so that a core of water flows within an annulus of the emulsion, and
   (v) passing the united flow of emulsion and dilute surfactant solution through a third low shear mixer in such a manner that a diluted emulsion is formed comprising oil droplets in an aqueous medium, the oil droplets having a mean droplet diameter in the range 2 to 50 micron, and a high degree of monodispersity.

4. A method according to claim 3 wherein the viscosity of the oil is above 200 mPa's.

5. A method according to claim 1 wherein the mean droplet diameter is in the range 5 to 20 micron.

6. A method according to claim 1 wherein the degree of monodispersity is such that at least 60% of the volume of the oil droplets have a diameter within ±70% of the mean droplet diameter.

7. A method according to claim 6 wherein the degree of monodispersity is such that at least 60% of the volume of the oil droplets have a droplet diameter within 30% of the mean droplet diameter.

8. A method according to claim 3 wherein the concentration of oil in the first stage emulsion is in the range 85 to 95% by volume and in the range 60 to 75% by voume in the diluted emulsion.

9. A method according to claim 1 wherein the surfactant is a non-ionic surfactant containing a hydrophobic, hydrocarbyl group and a hydrophilic polyoxyethylene group containing 9 to 100 ethylene oxide units.

10. A method according to claim 9 wherein the surfactant is an ethyoxylated alkyl phenol wherein the polyoxyethylene group contains 15 to 30 ethylene oxide units.

11. A method according to claim 10 wherein the surfactant is an ethoxylated nonyl phenol containing about 20 ethylene oxide units.

12. A method for the combustion of an emulsified fuel oil characterised by the fact that the emulsion is prepared by a method according to claim 1 and combustion is effected under conditions such that particulate emissions are reduced to a value close to or at the ash level of the fuel oil and $NO_x$ emissions are reduced.

13. A method for the combustion of a fuel oil according to claim 12 wherein the quantity of air employed in said combustion is in the range from 5 to 50% excess.

14. A method for the combustion of a fuel oil according to claim 12 wherein the quantity of air employed in said combustion is in the range from 5 to 20% excess.

15. A method for the preparation of an emulsion of an oil in water which method comprises the steps of:

uniting a flow of oil having a viscosity in the range of 25 to 250,000 mPA's at the mixing temperature with a flow of aqueous surfactant solution in a controlled manner such that a core of surfactant solution flows within an annulus of the oil, the combined flow containing 60 to 98% by volume of oil, passing the united flow of oil and surfacant solution through a low shear mixer in such a manner that an emulsion is formed comprising oil droplets surrounded by an aqueous film, the oil droplets having a mean droplet diameter in the range 2 to 50 micron, and a high degree of monodispersity.

16. A method according to claim 15 further comprising the steps of: uniting the flow of said emulsion with a further quantity of water in a controlled manner so that a core of water flows within an annulus of the emulsion, and passing the united flow of said core within said annulus through another low shear mixer in such a manner that a diluted emulsion is formed comprising oil droplets in an aqueous medium, the oil droplets having a mean droplet diameter in the range 2 to 50 micron, and a high degree of monodispersity.

17. A method for the combustion of an emulsified fuel oil characterised by the fact that the emulsion is prepared by a method according to claim 15 and combustion is effected under conditions such that particulate emissions are reduced to a value close to or at the ash level of the fuel oil and $NO_x$ emissions are reduced.

18. A method for the combustion of a fuel oil according to claim 16 wherein the quantity of air employed in said combustion is in the range from 5 to 50% excess.

19. A method for the combustion of a fuel oil according to claim 16 wherein the quantity of air employed in said combustion is in the range from 5 to 20% excess.

* * * * *